US007912241B1

(12) United States Patent
Graber

(10) Patent No.: US 7,912,241 B1
(45) Date of Patent: Mar. 22, 2011

(54) FIELD SERVICEABLE PLANAR LOUDSPEAKER

(76) Inventor: Curtis E. Graber, Woodbum, IN (US)

( * ) Notice: Subject to any disclaimer, the term of this patent is extended or adjusted under 35 U.S.C. 154(b) by 1270 days.

(21) Appl. No.: 11/492,495

(22) Filed: Jul. 25, 2006

(51) Int. Cl.
*H04R 25/00* (2006.01)

(52) U.S. Cl. ..... 381/431; 381/398; 381/408

(58) Field of Classification Search ..... 381/176, 381/398, 399, 408, 423, 431; 181/171, 172; 29/592.1, 594, 609.1; 16/353, 380, 381; 335/209, 306

See application file for complete search history.

(56) References Cited

U.S. PATENT DOCUMENTS

| | | | | |
|---|---|---|---|---|
| 3,188,686 | A * | 6/1965 | Orcutt | 16/263 |
| 3,733,649 | A * | 5/1973 | Nagy et al. | 16/380 |
| 4,156,801 | A | 5/1979 | Whelan et al. | |
| 4,385,418 | A * | 5/1983 | Loftis et al. | 16/381 |
| 4,803,733 | A | 2/1989 | Carver et al. | |
| 5,850,461 | A | 12/1998 | Zelinka | |
| 6,317,928 | B1 * | 11/2001 | Guillemette | 16/353 |
| 6,934,402 | B2 | 8/2005 | Croft, III et al. | |
| 2004/0022407 | A1 * | 2/2004 | Steere et al. | 381/398 |
| 2004/0022408 | A1 * | 2/2004 | Mango et al. | 381/408 |

* cited by examiner

*Primary Examiner* — Huyen D Le
(74) *Attorney, Agent, or Firm* — Paul W. O'Malley

(57) ABSTRACT

A push-pull magnetic-planar acoustic transducer provides easy field replacement of a diaphragm. Push-pull magnetic-planar acoustic transducers are known for the relative vulnerability of their diaphragms to damage. Replacement of the transducers in the field as been problematic because of the high repulsive force between the front and back panels and the need to obtain even tension across the diaphragm. The push-pull transducer assembly incorporates an edge hinge on which the panels can be pivoted to bring the panels into facing positions and a plurality of set screws to be fitted around the perimeter of the panels allowing essentially flat closure of the panels on one another to a working spacing engaging the diaphragm.

6 Claims, 8 Drawing Sheets

FIELD SERVICEABLE PLANAR LOUDSPEAKER

BACKGROUND OF THE INVENTION

1. Technical Field

The invention relates to planar-magnetic loudspeakers and more particularly to a push-pull, planar-magnetic loudspeaker allowing field replacement of the diaphragm.

2. Description of the Problem

FIG. 1 illustrates a double-ended, or push-pull, magnetic-planar transducer 20, conventional in the prior art. This structure is characterized by two magnetic arrays 10 and 11 supported by perforate substrates 14, 24 positioned on opposite sides of a flexible diaphragm 12, which includes a conductive coil 13. The film is tensioned into a planar configuration. An audio frequency drive signal is supplied to the coil 13, and a variable voltage and current thereby provided in the coil gives rise to a variable magnetic field, which interacts with the fixed magnetic field set up by and between the magnet arrays 10 and 11. The diaphragm is displaced in accordance with the audio frequency drive signal, thereby generating a desired acoustic output. An example representing this art area is found in U.S. Pat. No. 4,156,801 issued to Whelan.

Because of a doubled-up, front/back magnet layout of the prior art push-pull magnetic structures, double-ended systems have been generally regarded as more efficient, but also as more complex to build. Double-ended designs are also particularly sensitive to deformation from repulsive magnetic forces that tend to deform the devices outward. Outward bowing draws the edges of the diaphragm closer together, and alters the tension of the diaphragm. This can seriously degrade performance and, over time, can render the speaker unusable necessitating disposal or repair of the unit.

Assembly of push-pull structures presents its own difficulties. As observed in U.S. Pat. No. 6,934,402 issued to Croft III, et al., the magnetic circuits of the front and back magnetic structures interact. The repulsion forces make it difficult to have a stable mechanical structure, while providing a focused field and making better use of magnetic material than single-ended devices. Assembly of push-pull structures presents its own difficulties. Like magnetic poles are brought into close proximity, requiring substantial force to bring the assembly together.

In U.S. Pat. No. 5,850,461 it was further observed that in the field of planar magnetic acoustic transducers and related flat type transducers utilized for sound reproduction, the tensioning of the sound producing diaphragms is important to obtain uniform sound reproduction. The proper tensioning of a diaphragm within a support frame has created difficulty in manufacturing processes. In planar magnetic transducers, if sufficient diaphragm tensioning is not provided, the diaphragm may vibrate into one of the stators formed by spaced magnets mounted within a support frame in spaced relationship with respect to an electrical circuit applied to the diaphragm. Improper tensioning throughout the diaphragm also results in changes in the vibrational characteristics of the diaphragm throughout its "sound producing" or "active" area which is generally that area defined internally of the diaphragm support frame.

SUMMARY OF THE INVENTION

According to the invention a push-pull, planar-magnetic acoustic transducer comprises a front panel incorporating an array of magnets set in an aperture and a back panel including an array of magnets set in an aperture, where upon assembly the front and back panels are held parallel to one another in close proximity with like polarity poles of the magnets aligned on one another. The front and back panels are coupled together along one major side of each on a pivot/hinge bar. The pivot bar extends through slots in alternating sections of the front and back panels where the slots through the sections of one of either the front or back panels are elongated in the front to back direction of the panel. Set screws are fitted to hold the front and back panels together in the facing, parallel assembly.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
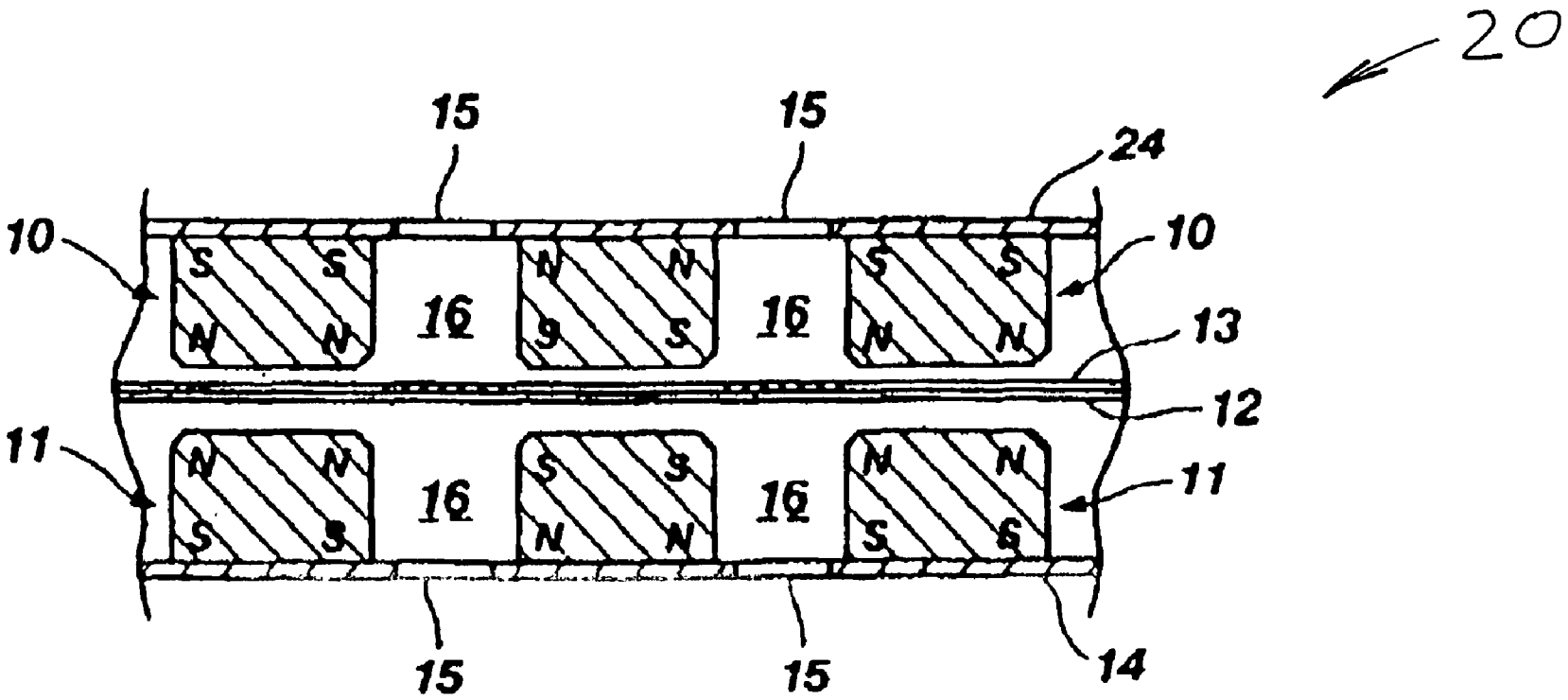
Fig. 1 (PRIOR ART)
FIG. 1 is a cross-sectional fragmentary view of a prior art push-pull planar-magnetic transducer.
Figure 2:
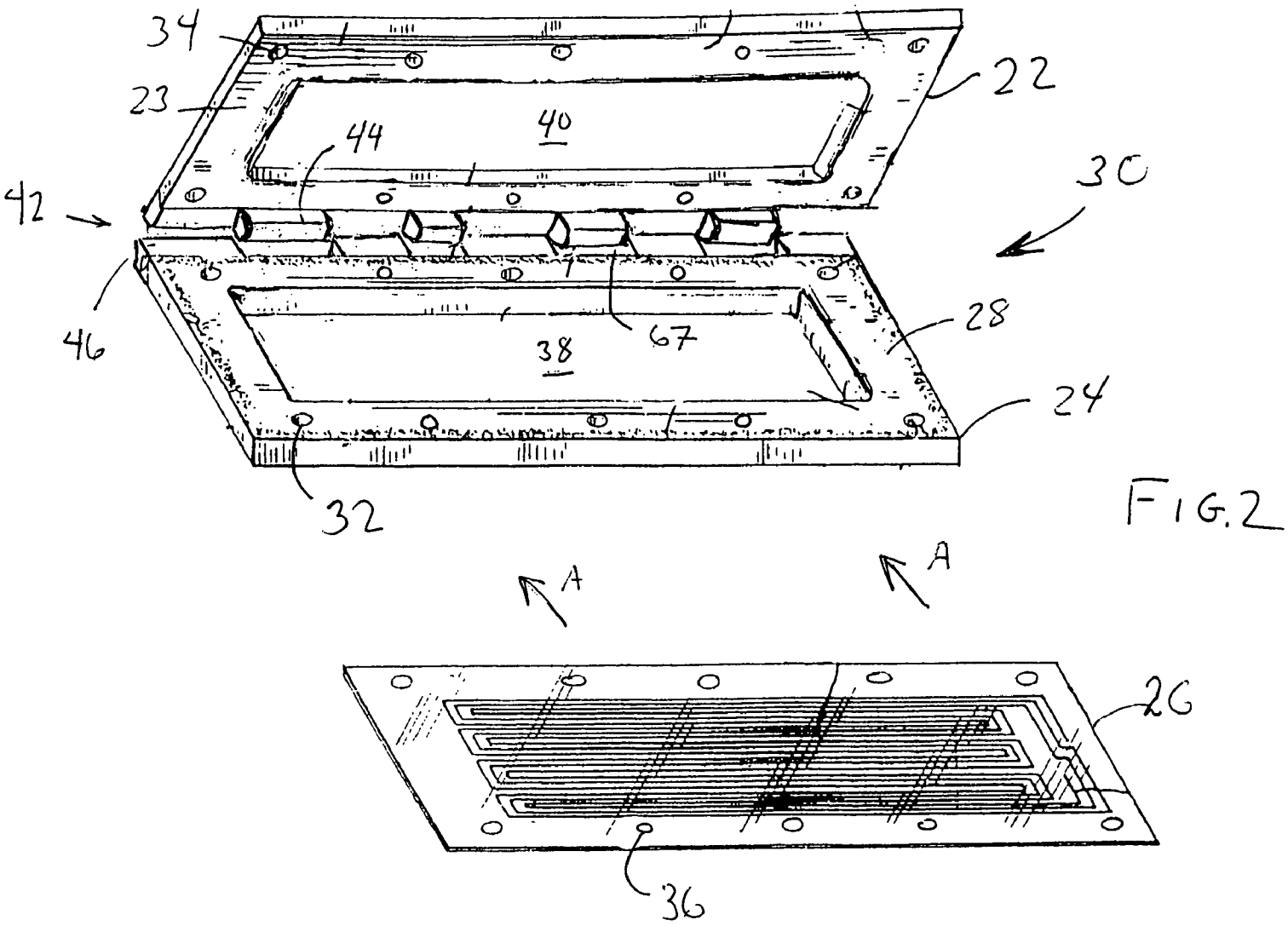
FIG. 2 is a perspective view of a planar magnetic transducer according to the invention opened for replacement of its diaphragm.
Figure 4:
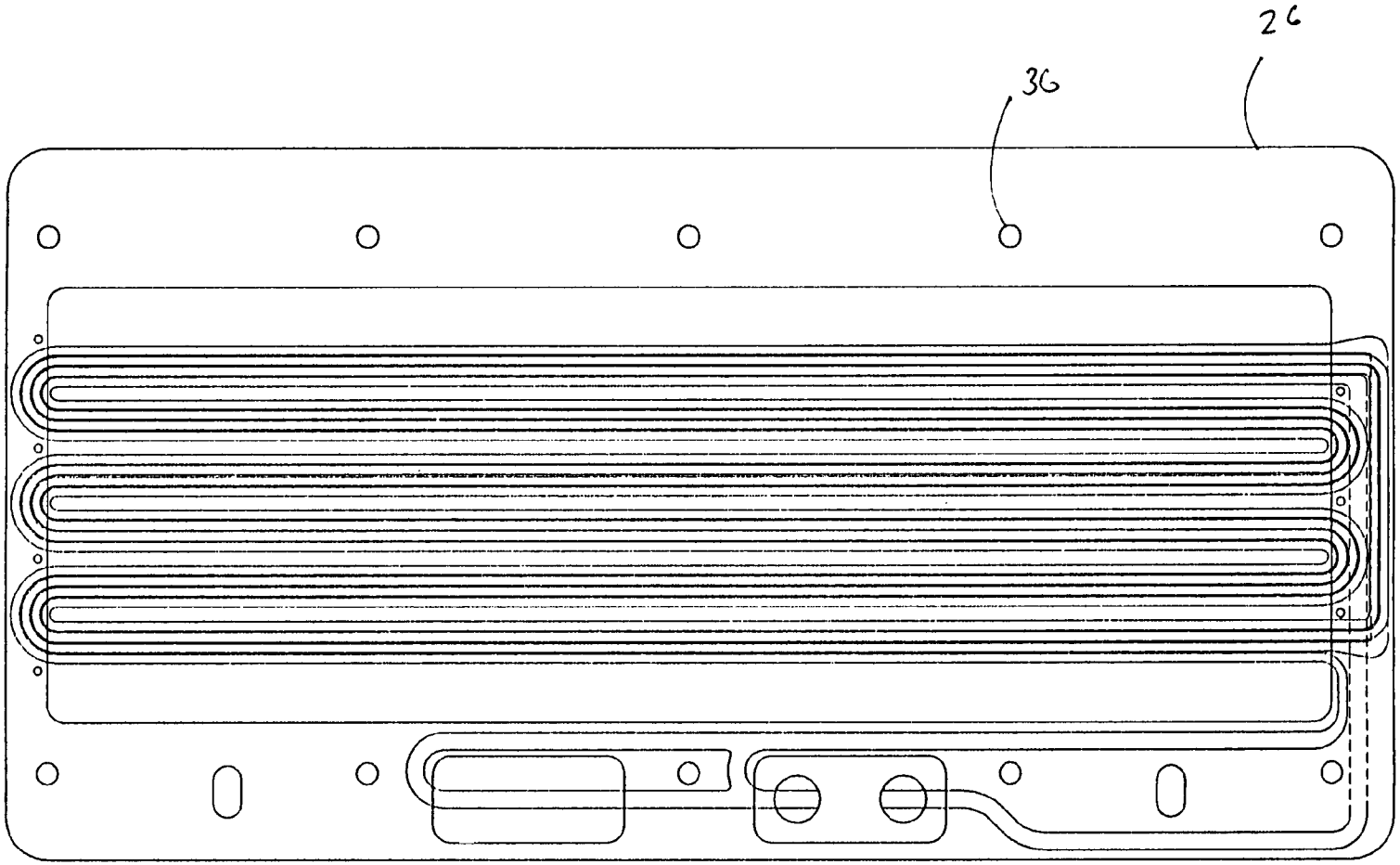
FIG. 4 is a top plan view of a diaphragm for the planar-magnetic transducer of FIG. 3.

Referring now to the figures and in particular to FIG. 2 an opened clam shell 30 for use in constructing a double-ended, or push-pull, magnetic-planar transducer is shown. Clamshell 30 comprises a front panel 22 and a back panel 24 which are linked by a hinge structure 42 along one of major (i.e. longer) edges of each panel. Front panel 22 and back panel 24 include central apertures 40 and 38 respectively, in which may be placed any preferred arrangement of magnets. Central apertures 40, 38 connect opposite major surfaces of the front and back panels 22, 24. A diaphragm 26 (shown more particularly in FIG. 4) for introduction to the clam shell 30 as indicated by arrows A is placed on the forward major surface 28 to be pressed between the front panel 22 and back panel 24 upon closure of clam shell 30.

An important characteristic of front and rear panels 22, 24 are threaded holes 34, 32, visible on the rearward facing major surface 23 and the forward facing surface 28 of the front and back panels, respectively. Upon assembly the alignment holes 36 of diaphragm 26 align on and between threaded holes 34, 32. Upon placement of diaphragm 26 on the forward face 28 alignment holes 36 must be brought into precise alignment with alignment holes 32.

Hinge 42 is constructed between interlaced blocks 44, 46. Four blocks 44 extend downwardly from rearward surface 23 into gaps 67 between blocks 46 extending outwardly from the relatively rear surface of back panel 24. In this way the blocks 44, 46 of the respective panels alternate in sequence along a major edge of each of the panels. The hinge itself, as described below, allows the front panel 22 to translate or move front to back or back to front a short distance while the panels remain in a flat, parallel orientation with respect to each other. That is to say, the direction of movement of the front panel 22 may upon opening be kept perpendicular to the panel's major surfaces for a short distance. Conversely, upon closure, the front panel 22 may be brought into a parallel, facing position with the back panel 24 manually at a spacing where the repulsive force generated by the magnets is not too strong to prevent such movement.

Figure 3:
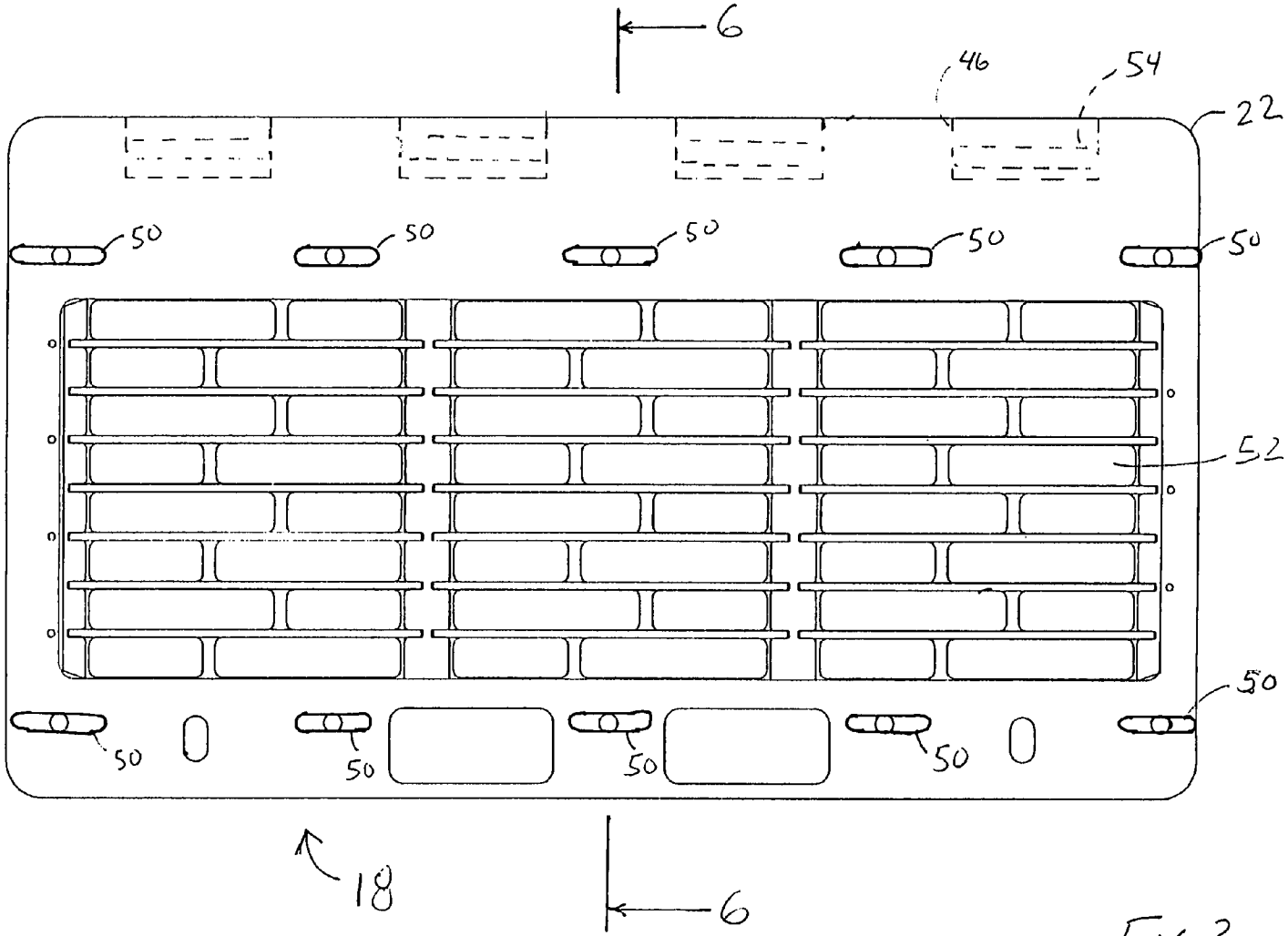
FIG. 3 is a top plan view of a planar-magnetic transducer in accordance with the invention.

Referring to FIG. 3, a planar-magnetic transducer 18 is shown constructed in accordance with the invention from clamshell 30. Bar magnets 52 are placed in aperture 40 and the clamshell 30 is held closed by set screws threaded into the alignment holes 34, 32 of the front and back panels 22, 24. Front panel 22 is linked to back panel 24 by a hinge bar 54 located in the gaps 67 between the blocks 46 and which passes through blocks 44. The relatively elongated heads 50 of the set screws enables turning the set screws to bring the front and back panels 22, 24 into closer proximity against the strong repulsive force of the magnets.

Figure 5:
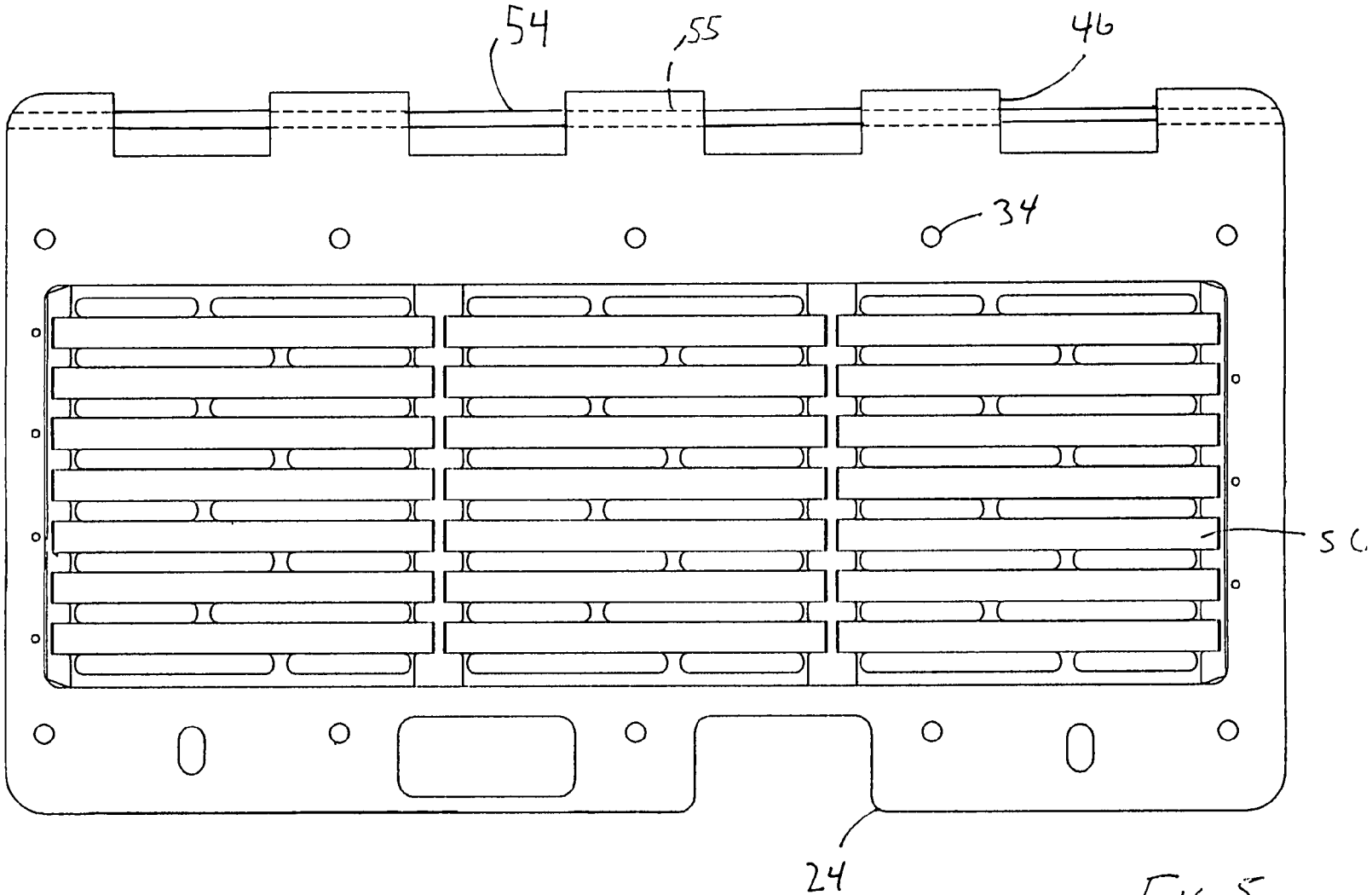
FIG. 5 is a top plan view of a base plate for the planar-magnetic transducer of FIG. 3.

Referring to FIG. 5, a hinge bar 54 is shown inserted through slots 55 in blocks 46 of back panel 24. Normally the hinge bar 54 is normally inserted to attach a front panel to the back panel. Magnets 56 are also illustrated placed in aperture 38.

Figure 6:
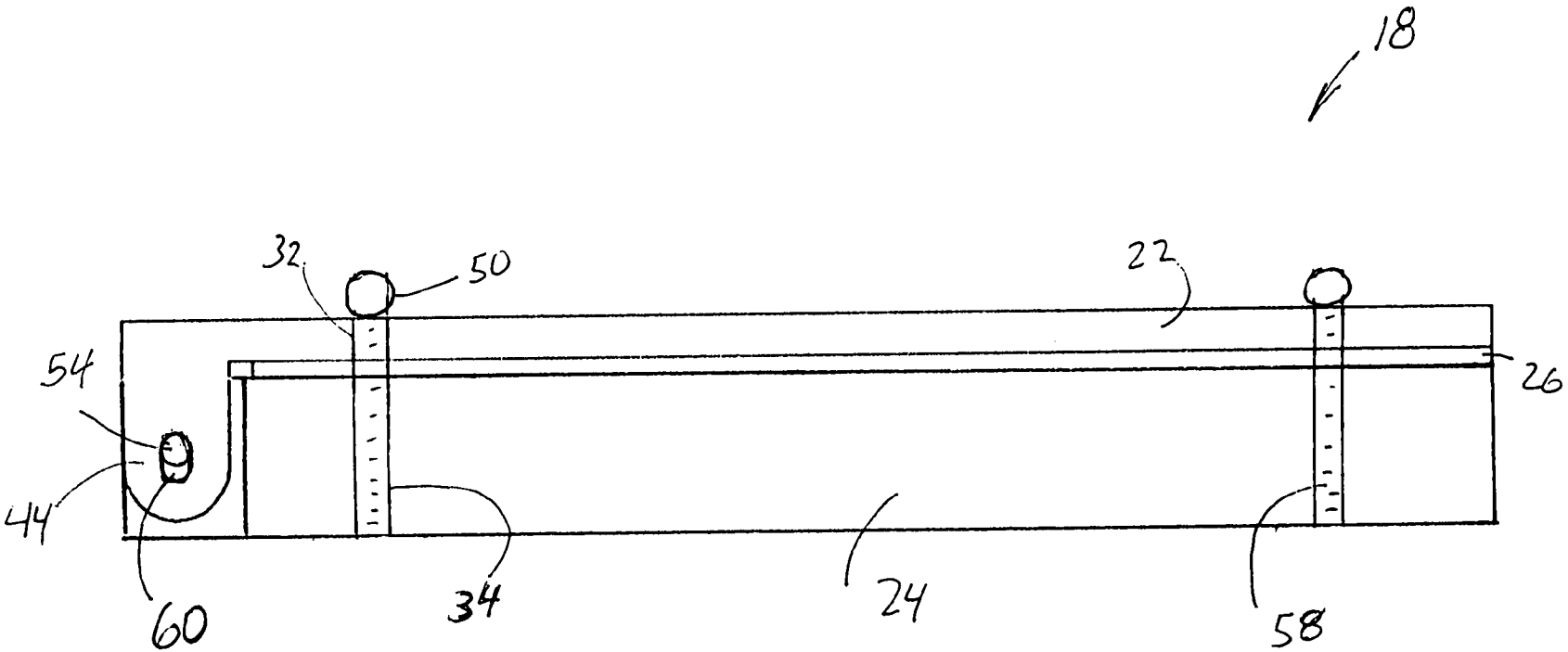
FIG. 6 is a cross sectional view of the planar-magnetic transducer of FIG. 3 taken along section lines 6-6.

Referring to FIG. 6 planar-magnetic transducer 18 is shown in a cross sectional view with front panel 22 clamping diaphragm 26 against rear panel 24. The panels are held against each other by ten set-screws 58 which have been inserted into alignment holes 34 and tightened only fully inserted. In order to maintain the panels in a nearly parallel alignment, and to enable closure of the panels against one another against the repulsive force generated by the magnets 56, 58, the pitch of the threads is shallow and the screws are inserted nearly synchronously, or in alternating partial turns. An oblong or elongated slot 60 is visible through block 44 into which hinge bar 54 has been inserted. When panel 22 is fully pressed against diaphragm 26 and back panel 24, hinge bar 54 is pressed against the "upper" end of the elongated slot 60. It will be understood that bar 54 corresponds almost exactly in diameter to slot 55 through blocks 46. The direction of elongation is parallel to the front to back direction of the panel in the assembled transducer 18.

Figure 7:
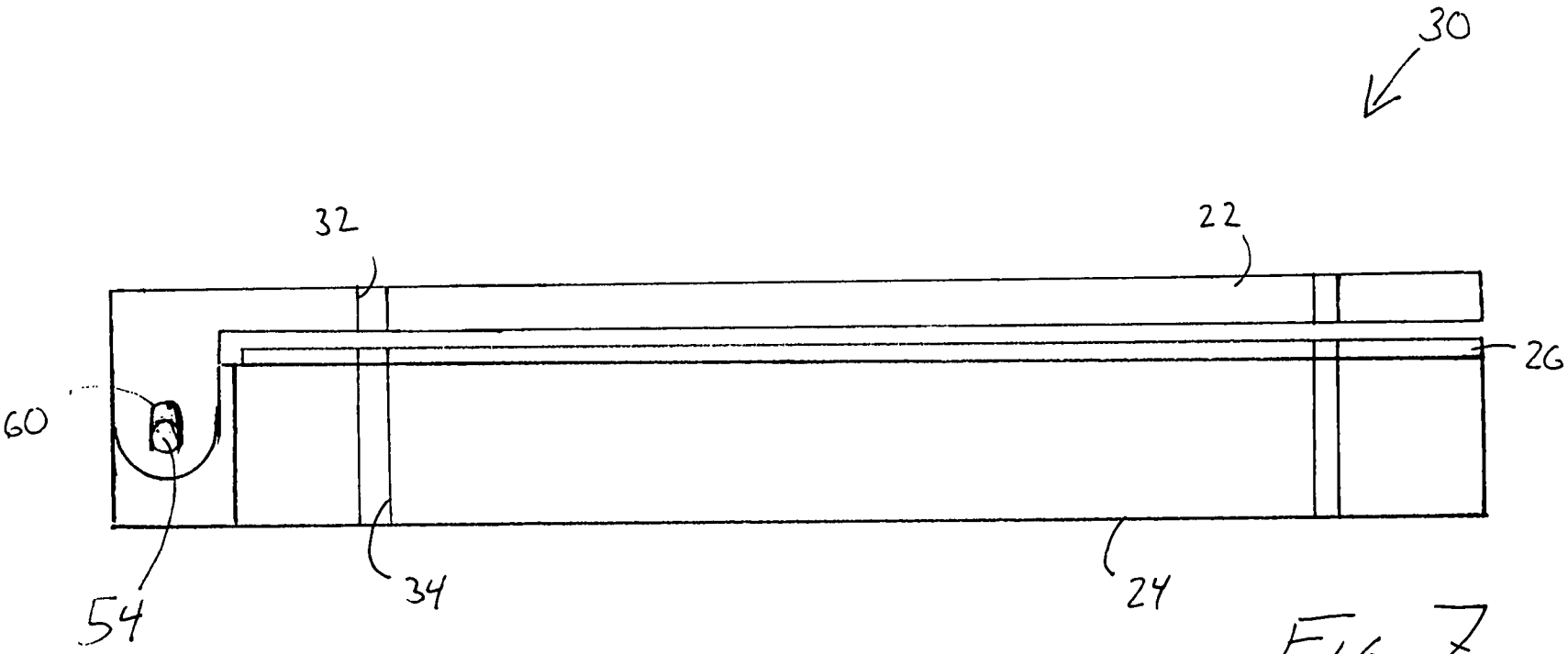
FIG. 7 is a cross sectional view of the planar-magnetic transducer with set screws released.
Figure 8:
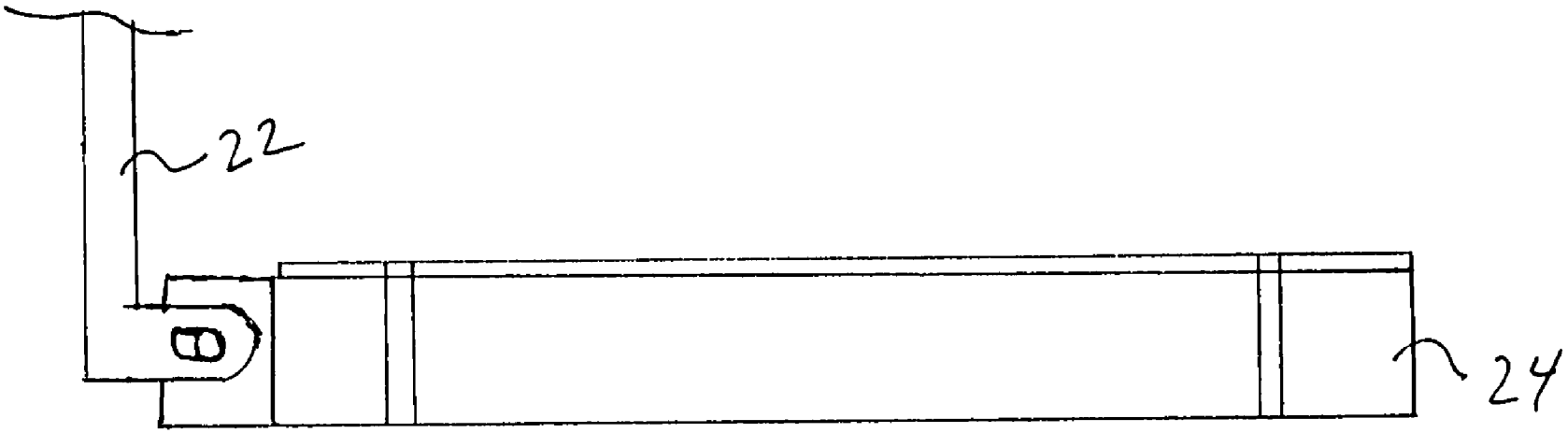
FIG. 8 is a cross sectional view of the planar-magnetic transducer opened for replacement of a diaphragm.

With removal of threaded set-screws 58 front panel 22 moves away from back panel 24, as is shown by the gap between diaphragm 26 and front panel 22, and by the illustration of hinge bar 54 being located at the bottom of elongated slot 60 as shown in FIG. 7. It is desirable for assembly and disassembly that C-clamps or similar devices are used as restraints while the set screws are inserted and removed do to the powerful repulsive forces generated by the opposed magnets. As illustrated in FIG. 8, this allows top panel 22 to be pivoted away from back panel 24.

The invention provides a field serviceable push-pull magnetic-planar transducer which allows field replacement of diaphragms.

While the invention is shown in only one of its forms, it is not thus limited but is susceptible to various changes and modifications without departing from the spirit and scope of the invention.

What is claimed is:

1. A push-pull, planar-magnetic acoustic transducer, comprising:

a front panel incorporating an array of magnets;

a back panel including an array of magnets;

a hinge structure connecting the back panel to the front panel along a major edge of each;

the hinge structure including a pivot bar coupling the front and back panels to one another and a plurality of sections which depend in alternating order from the front and back panels and which interlace upon assembly, with the sections which depend from one of either the front or back panel incorporating an oblong slot for admitting the pivot bar, the oblong slot being elongated in the front to back direction of the push-pull, planar-magnetic acoustic transducer which allows the front and back panels to be moved relative to one another while held face to face; and set-screws holding the front and back panels together in facing, parallel assembly.

2. A push-pull, planar-magnetic acoustic transducer as described in claim 1, further comprising:

the front and back panels having central apertures connecting the major surfaces of the front and back panels and in which the arrays of magnets are placed;

a plurality of threaded bore holes distributed around the central apertures in each of the front and back panels into which the set-screws are inserted for holding the front and back panels in proximate, facing position, the set screws being long enough to extend through the front panel into engagement with the back panel up to the maximum spacing allowed between the back and front panels by the hinge structure when the front panel and back panel are facing one another and parallel.

3. A push-pull, planar-magnetic acoustic transducer as described in claim 2, further comprising:

a diaphragm for insertion between the front and back panels, the diaphragm having a plurality of alignment holes for alignment on the threaded bore holes of the back panel.

4. A push-pull, magnetic-planar acoustic transducer with a replaceable diaphragm, comprising:

front and back panels incorporating arrays of magnets;

an edge hinge coupling the front and back panels along a major edge of the panels on which the panels can be pivoted to bring the panels into facing opposition and opened to allow replacement of the diaphragm from between the panels; and the edge hinge including interlaced blocks also allowing front to back and back to front translation of the front and back panels with the panels remaining in a flat, parallel and facing orientation with respect to one another and without pivoting of the panels with respect to one another on the edge hinge.

5. A push-pull, magnetic-planar acoustic transducer with a replaceable diaphragm as described in claim 4, further comprising:

a plurality of distributed, incrementally adjustable clamping elements for drawing the front and back panels toward one another and holding the panels in close proximity to one another with a diaphragm pinched between the panels from the location of maximum spacing of the front and back panels when facing and parallel to one another.

6. A push-pull, magnetic-planar acoustic transducer with a replaceable diaphragm as described in claim 5, further comprising:

physical modifications of the back panel for guiding alignment of a replacement diaphragm on the back panel; and a plurality of set screws to be fitted around the perimeter of the panels allowing essentially flat closure of the panels on one another to a working spacing engaging the diaphragm.

* * * * *